US006360959B1

(12) United States Patent
Kent et al.

(10) Patent No.: US 6,360,959 B1
(45) Date of Patent: Mar. 26, 2002

(54) DUAL RESIST DISPENSE NOZZLE FOR WAFER TRACKS

(75) Inventors: Eric R. Kent, San Jose; Vince L. Marinaro, Sunnyvale; Ted Wakamiya, San Ramon, all of CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/592,920

(22) Filed: Jun. 13, 2000

(51) Int. Cl.[7] ..... B05B 17/00

(52) U.S. Cl. ..... 239/1; 239/13; 239/135; 239/390; 239/397; 239/552; 239/600; 222/129; 222/146.2; 118/313

(58) Field of Search ..... 239/1, 13, 128, 239/135, 390, 391, 397, 548, 552, 600; 222/146.2, 146.4, 129, 135, 145.1, 145.3, 132; 118/300, 313

(56) References Cited

U.S. PATENT DOCUMENTS 5,141,155 A * 8/1992 Jacobsen ..... 239/390 X
5,196,064 A * 3/1993 Branderhorst et al. ..... 239/600
5,720,814 A * 2/1998 Takagi et al. ..... 118/315 X
5,979,794 A * 11/1999 DeFillipi et al. ..... 239/135

* cited by examiner

*Primary Examiner*—Steven J. Ganey
(74) *Attorney, Agent, or Firm*—Foley & Lardner

(57) ABSTRACT

A dual tip nozzle replaces a single tip nozzle in a resist applicator station to double the number of photoresists that are available. The resist applicator station is of the type having a nozzle holder block, at least one single tip nozzle attached to the nozzle holder bock, and a first resist line extending through the nozzle holder block and into engagement with the nozzle. The dual tip nozzle includes two cavities having respective orifices. Each cavity receives a separate resist line for dispensing separate photoresists.

20 Claims, 1 Drawing Sheet

DUAL RESIST DISPENSE NOZZLE FOR WAFER TRACKS

FIELD OF THE INVENTION

The present invention relates generally to a method of and apparatus for manufacturing an integrated circuit (IC). More specifically, this invention relates to an apparatus for and method of dispensing resist in a track utilized to fabricate ICs.

BACKGROUND OF THE INVENTION

The present invention applies particularly to the fabrication of semiconductor devices or integrated circuits. Some examples of these devices include non-volatile memory integrated circuits. Non-volatile memory integrated circuits include an EPROM, an EEPROM, a flash memory device, and a complementary metal oxide semiconductor ("CMOS") device. Exemplary devices may comprise transistors, such as metal oxide semiconductor field-effect transistors ("MOSFET") containing a gate over a gate insulator over silicon, as well as other transistors utilized in ultra-large-scale integrated-circuit ("ULSI") systems.

Integrated circuits are utilized in a wide variety of commercial and military electronic devices, including, e.g., hand held telephones, radios and digital cameras. The market for these electronic devices continues to demand devices with a lower voltage, lower power consumption and a decreased chip size. Also, the demand for greater functionality is driving the "design rule" lower, for example, into the sub-half micron range.

These integrated circuit devices are generally fabricated in groups on a semiconductor wafer. During fabrication, a photolithographic process is utilized to form various components and structures. The components and structures are formed according to a photolithographic pattern provided on the semiconductor wafer. This photolithographic process is conventionally utilized throughout semiconductor wafer production. There are three basic steps involved in the photolithographic processing of each semiconductor wafer. First, a photoresist is applied to each wafer in a coater. Each wafer is then exposed to a radiation source in a stepper, and finally each exposed wafer is developed in a photoresist developer. Since the IC are typically multilayered, this process is repeated a number of times.

More specifically, in a portion of the photolithographic process, a photoresist coater and developer system is utilized in the patterning of various layers of the wafer that will form the structures on the wafer. The photoresist coater and developer system applies, or coats, a light-sensitive resin, i.e., a photoresist layer, to wafers by depositing a preselected amount of the photoresist solution. Next, the system spins the wafers at a relatively high rate of speed to distribute the photoresist into a relatively even coating over the wafer. Then, the wafers are baked to induce a volatization of a casting solvent in the photoresist. Next, the wafers are exposed to a light source in a stepper, e.g., a deep ultraviolet ("DUV") light source, for patterning. The exposed wafers are then developed by a chemical treatment, and are again baked to dry the wafers.

Conventional examples of resist coater and developer systems, e.g., are the Tokyo Electron Limited (TEL) sub-half micron compatible Coater/Developer Clean Track systems. Conventional systems may include a chemically amplified resist ("CAR") in the deep ultraviolet ("DUV") process that has been adopted for the sub-half micron design rule type of circuit devices. The combination of the coater and developer is typically referred to as a "track."

As to the development of the photoresist that has been formed on the wafer, conventionally, a chemical developer is utilized to remove areas defined in the steps of masking and exposure of the photoresist layer that has been deposited on the wafer. The development of the photoresist is an important part of the wafer fabrication.

For example, in sub-half micron semiconductor processing, one of the most important parameters in the photolithography area is the critical dimension ("CD"). The above described relatively complex integrated circuits will only function as designed if the critical dimensions are within tolerance or specification. There are many parameters that control the critical dimension. One of these parameters comprises cleanliness. Thus, there is a requirement for an essentially contamination-free wafer fabrication environment.

As discussed above, IC's are often multi-layered. Accordingly, once the lot of wafers has been processed, the process of photoresist application, exposure, and developing is repeated on the lot until the IC's are completed. The type of photoresist that is applied for each layer of the IC may be different than the previous photoresists that have been applied. Additionally, a different type of photoresist may require a different developer material.

A track includes a least one resist application station or coater cup. Each application station includes three different nozzles that can apply a different resist to the wafers. In a typical setup with two different resist application stations the track has the ability to apply six different photoresists.

In order to minimize the possibility of contamination, only one resist is applied by a specific nozzle. The only way to select from additional resists is to either add additional resist applicaton stations, or to first clean the entire line and nozzle to ensure that no residue of the prior resist is present before applying a different resist.

In addition to the problem of contamination from a prior resist, certain resists react with one another and coagulate, further complicating the application and drainage of the resists.

Since, the fabrication of wafers often demands the use of a number of resists, a fabricator has the choice of cleaning out the various nozzles or purchasing additional resist application stations. The former approach results in excessive downtime, and the latter approach adds expense in the form of additional capital expenditure. Additionally, every new station that is added requires additional space thereby making transportation along the track longer and more complicated.

Accordingly, it would be desirable to develop a method of and apparatus for modifying existing track systems to permit the application of additional photoresists without the need for an additional applicator station.

SUMMARY OF THE INVENTION

One embodiment relates to a semiconductor resist applicator nozzle apparatus. A nozzle including a first end is coupled to an opening in a container. The nozzle includes a first and second orifice. A first resist line extends through the first opening of the container to supply a first resist to the first orifice. A second resist line extending through the container to supply a second resist to the second orifice.

Another embodiment includes a method for doubling the number of photoresists available in a resist applicator station. The resist applicator station is of the type having a nozzle holder block, at least one single tip nozzle attached to the nozzle holder block, and a first resist line extending through the nozzle holder block and into engagement with the single tip nozzle. The method includes removing the single tip nozzle from an opening in the nozzle holder block. A second resist applicator line is extended along with the first resist line through the nozzle holder block. A dual tip nozzle having a first cavity and a second cavity is coupled to the nozzle holder block, with the first and second resist lines located in the first and second cavities respectively.

A further embodiment includes a kit for modifying a resist applicator station. The resist applicator station is of the type having a nozzle holder block, at least one single tip nozzle attached to the nozzle holder bock, and a first resist line extending through the nozzle holder block and into engagement with the single tip nozzle. The kit includes a dual tip nozzle having a first attachment end. The dual tip nozzle also includes a first tip and a second tip. Each tip has a separate cavity with a respective orifice. The kit also includes a coupler to secure the attachment end of the dual tip nozzle to the nozzle holder block.

DETAILED DESCRIPTION OF THE PREFERRED EMBODIMENTS

Figure 1:
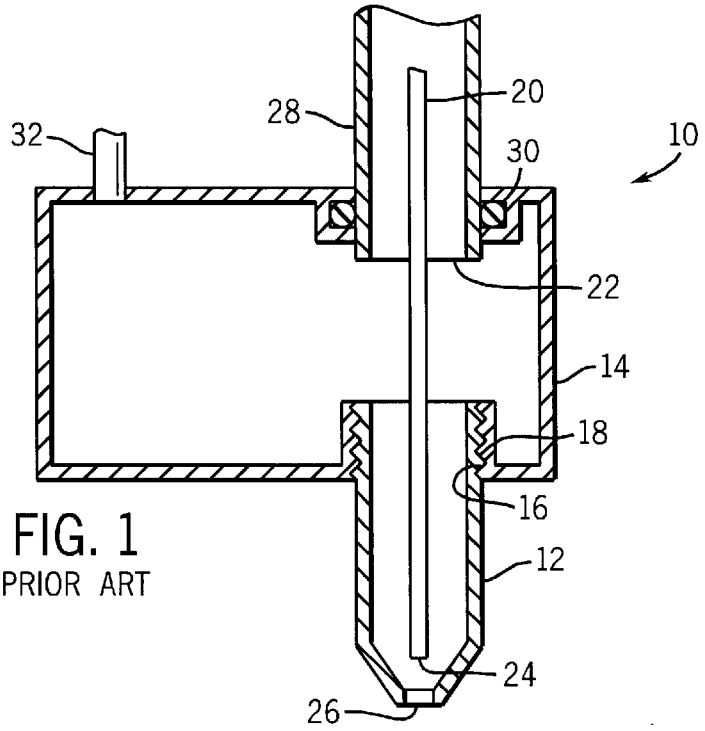
FIG. 1 PRIOR ART
FIG. 1 is a schematic illustration of the prior art nozzle for application of resist.

An exemplary prior art nozzle system 10 for application of a photoresist is schematically illustrated in FIG. 1. The prior art system 10 includes a nozzle 12 coupled to a nozzle holder block 14. Nozzle 12 includes an external threaded portion 16 that is secured to an internal threaded portion 18 in block 14. A first resist line 20 extends though a first opening 22 in block 14, through block 14, through the internal threaded portion 18 of block 14, and into engagement with nozzle 12. An end 24 of first resist line 20 is located near an orifice 26 of nozzle 12. A control tube 28 is secured to block 14 with a first o-ring 30. A temperature controlled liquid such as water is circulated through control tube 28 and block 14 to maintain the temperature of the resist at a predetermined temperature. The water exits block 14 at an exit tube 32.

Each nozzle 12 is typically supplies a single type of resist. This is to minimize contamination from a different type of resist, as well as to minimize the time required to setup a different type of resist. As discussed above, each photoresist station or cup typically supports three nozzles. When a different resist is needed then that supplied by a specific nozzle, another nozzle is used in the same or different station. Alternatively, the nozzle can be first cleaned after which a new photoresist may be introduced without the risk of contamination.

Figure 2:
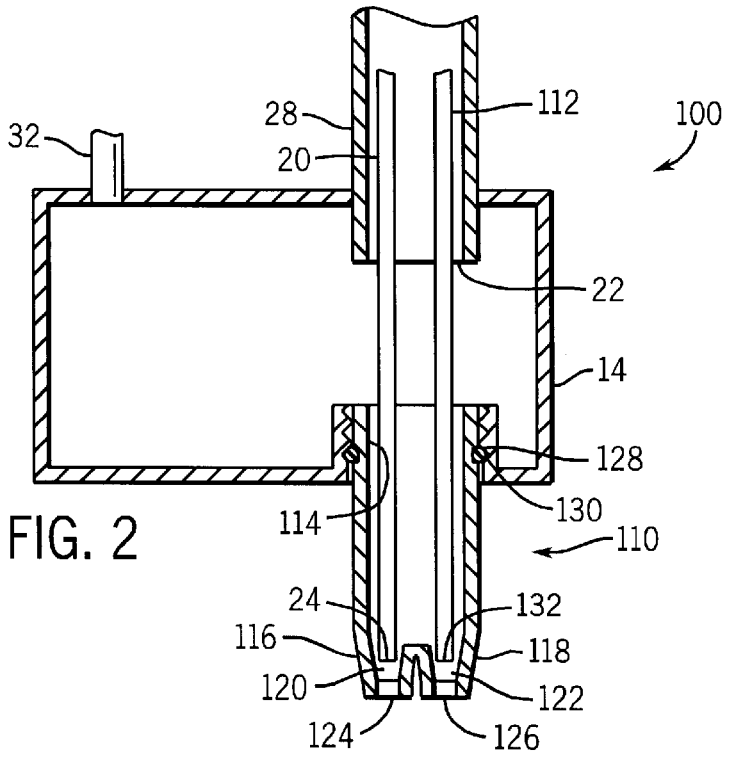
FIG. 2 is a schematic illustration of a dual tip nozzle for application of two separate resists.

Turning now to FIG. 2 an exemplary embodiment nozzle system 100 is described. The same reference numerals as those used to describe system 10 (FIG. 1) are used to describe like components in system 100 (FIG. 2). One benefit of the exemplary embodiment is that it can be practiced with and easily retrofitted to an existing system.

As illustrated in FIG. 2 nozzle system 100 includes a nozzle 110 having a first attachment portion 114 that is coupled to nozzle holder block 14 (e.g. a container). Nozzle 110 includes two tips 116, 118 distal the attachment portion 114. Each tip 116, 118 includes a respective cavity 120, 122 having a respective orifice 124, 126. Each cavity 120, 122 is separated from one another to prohibit the different photoresists from mixing.

A coupler 128 secures nozzle attachment portion 114 to nozzle holder block 14. In the exemplary embodiment, attachment portion 114 has an outer diameter that is less than the inner diameter of the internal threaded portion in block 14. An o-ring 130 is attached to attachment portion 114. The o-ring 130 has an outer diameter that is greater than the inner diameter of the inner threaded portion 18. As a result when the attachment portion 114 and o-ring 130 are inserted into the inner threaded portion of 18 block 14, the o-ring is compressed and portion 114 is frictionally coupled to the nozzle holder block 14. The frictional engagement of the nozzle 110 must be sufficient to maintain the nozzle attachment portion 114 within internal threaded portion 18 during operation.

A second resist line 112 is surrounded by control tube 28 along with first resist line 20. Control tube 28 can operate as a single heat exchanger for both of lines 20 and 112. Both first and second resist lines 20, 112 extend through the first opening 22 in nozzle holder block 14, through the nozzle holder block 14, through the internal threaded portion 18 of the block and into engagement with nozzle 110. The end 24 of first resist line is located in first cavity 120 within first tip 116 and proximate first orifice 124. Similarly, an end 132 of second resist line 112 is located in second cavity 122 within second tip 118 and proximate second orifice 126.

The coupler 128 described utilizes an o-ring 130 to secure portion 114 of the nozzle 110 to nozzle holder block 14. However, other types of couplers may be used, for example it is possible to use an external threaded portion on portion 114 of nozzle 110 similar to the threaded portion discussed above with respect to nozzle 12. The problem associated with this type of threaded arrangement is that when the nozzle is rotated relative to the nozzle holder block 14, the resist lines are likely to become twisted. Additionally, the resist lines 20, 112 may not be properly aligned within the appropriate tips. Ideally, the coupler 128 should permit attachment of portion 114 of nozzle 110 to the nozzle holder block 14 without requiring the nozzle 110 to rotate relative to the nozzle holder block 14. There are numerous couplers that allow the coupling of two separate components without requiring either of the components to rotate relative to one another. It is however, possible to rotate the dual tip nozzle 110 relative to the nozzle holder block 14 through a limited angle of rotation to couple the dual tip nozzle to the nozzle holder block. The limited angle of rotation would minimize the problem associated with the twisting of the resist lines or dislocation of the resist lines from their respective cavities. For example limited rotation of less than ninety (90) degrees would be acceptable.

The number of resist options available for an existing system is doubled by simply replacing the existing single nozzle 12 with dual tip nozzle 110 and adding second resist line 112. In this manner the number of resists available, double from the typical three resists per station to six resists per station.

The method of installing dual tip nozzle 110 will now be discussed. First, existing nozzle 12 is removed from the nozzle holder block 14. A second resist line 112 along with the first resist line 20 is connected to the control tube 28 to permit heat transfer between the control tube 28 and the first and second resist lines 20, 112. The first and second resist lines 20, 112 are fed through the opening 22 in nozzle holder block 14, which is large enough to accommodate two resist lines. Thus, system 100 can advantageously utilize excess space associated with nozzle holder block 14.

The first and second resist lines 20, 112 are fed through the inner threaded portion 18 of nozzle holder block 14. The ends 24, 132 of first and second resist lines 20, 112 are then placed in the first and second cavities 120, 122 respectively of dual tip nozzle 110. The ends 24, 132 of first and second resist lines 20, 112 are placed proximate first and second orifices 124, 126 of the first and second cavities 120, 122 of nozzle 110.

In the exemplary embodiment o-ring 130 is placed on to first attachment portion 114 of dual tip nozzle 110 prior to feeding first and second resist lines 20, 112 through first attachment portion 114 and into first and second cavities 120, 122. 0-ring 130 and dual tip nozzle 110 are inserted into the internal threaded region of the nozzle holder block 14. Since the combined diameter of o-ring 130 and attachment portion 114 is greater than the inner diameter of the internal threaded opening in the nozzle holder block 14, portion 114 of dual tip nozzle 110 is frictionally coupled to the nozzle holder block 14.

Since, there may be more than one nozzle 12 in a standard resist applicator station it is important that the size of the dual tip nozzle 110 be similar in size to the single tip nozzle 12 that it is replacing. This is to ensure that the nozzles will fit within the resist applicator station. Additionally, the location of the two orifices of nozzle 110 must be positioned to provide adequate covering of the wafer to be processed. In the exemplary embodiment, portion 114 of dual tip nozzle 110 occupies substantially the same area as the single tip nozzle 12.

The nozzle holder block 14 is not limited to that shown but can be any structure that supports the dual tip nozzle and provides a path for the resist lines. While, the exemplary embodiment describes the replacement of one single tip nozzle with a dual tip nozzle, it is understood that any number of the single tip nozzles in a resist station may be replaced with the dual tip nozzles.

The invention has been described in reference to particular embodiments as set forth above. However, only the preferred embodiment of the present invention, and but a few examples of its versatility are shown and described in the present disclosure. It is understood that the present invention is capable of use in various other combinations and environments, and is capable of changes or modifications within the scope of the inventive concept as expressed herein. Also, many modifications and alternatives will become apparent to one of skill in the art without departing from the principles of the invention as defined by the appended claims.

What is claimed is:

1. A method for doubling the resists available in a resist applicator station having a nozzle holder block, at least one single tip nozzle attached to the nozzle holder block, and a first resist line extending through the nozzle holder block and into engagement with the at least one single tip nozzle, the method comprising:

removing the at least one single tip nozzle from an opening in the nozzle holder block;

extending a second resist applicator line along with the first resist line through the nozzle holder block; and coupling a dual tip nozzle having a first cavity and a second cavity to the nozzle holder block, the first cavity having a first orifice and the second cavity having a second orifice.

2. The method of claim 1, further including locating an end of the first resist line within the first cavity and locating an end of the second resist line within the second cavity.

3. The method of claim 2, further including locating the end of the first resist line proximate the first orifice, and locating the end of the second resist line proximate the second orifice.

4. The method of claim 1, wherein coupling the dual tip nozzle to the nozzle holder block, includes attaching an o-ring to an attachment portion of the dual tip nozzle and inserting the o-ring and attachment portion of the dual tip nozzle into the opening of the nozzle holder block, wherein the dual tip nozzle is frictionally coupled to the nozzle holder block.

5. The method of claim 1, wherein coupling the dual tip nozzle to the nozzle holder block includes coupling the dual tip nozzle to the nozzle holder block while they remain rotationally stationary relative to one another.

6. The method of claim 1, wherein the dual tip nozzle occupies substantially the same space as the single tip nozzle.

7. The method of claim 1, wherein coupling the dual tip nozzle to the nozzle holder block includes rotating the dual tip nozzle relative to the nozzle holder block less than ninety degrees.

8. A method for increasing the number of resists available in a resist applicator station of the type having a nozzle holder block, a single tip nozzle threadably attached to the nozzle holder block, and a first resist line extending through the nozzle holder block and into engagement with the single tip nozzle, the method comprising:

unscrewing the at least one single tip nozzle from a threaded opening in the nozzle holder block;

extending a second resist applicator line along with the first resist line through the nozzle holder block; and inserting a dual tip nozzle having a first cavity and a second cavity into the threaded opening of the nozzle holder block, the first cavity having a first orifice and the second cavity having a second orifice;

securing the dual tip nozzle within the threaded opening with a frictional force.

9. The method of claim 8 wherein securing the dual tip nozzle within the threaded opening with a frictional force includes placing an o-ring on a first end of the dual tip nozzle, and inserting the first end of the dual tip nozzle into the threaded opening.

10. The method of claim 9, further including placing a first end of the first resist line within the first cavity.

11. The method of claim 10, further including and placing the first end of the second resist line within the second cavity.

12. The method of claim 11, further including locating the end of the first resist line proximate the first orifice and locating the end of the second resist line proximate the second orifice.

13. A method for increasing the number of resists available in a resist applicator station having at least one single tip nozzle and at least one resist applicator line, the method comprising:

removing at least one single tip nozzle from a nozzle holder;

replacing the at least one single tip nozzle with a multiple tip nozzle having at least two cavities and two orificies;

extending a second resist applicator line along with a first resist line through the nozzle holder; and locating one end of the second resist applicator line within a first cavity of said at least two cavities, and locating one end of the first resist line within a second cavity of said at least two cavities.

14. The method of claim 13 wherein replacing the at least one single tip nozzle includes coupling the multiple tip nozzle to the nozzle holder while the multiple tip nozzle and nozzle holder remain rotationally stationary relative to one another.

15. The method of claim 14, wherein coupling the multiple tip nozzle to the nozzle holder includes placing an end of the multiple tip nozzle within an opening in the nozzle holder.

16. The method of claim 15, further including placing an o-ring on the end of the multiple tip nozzle, and inserting the end of the multiple tip nozzle into the opening.

17. The method of claim 16, further including threading the second resist line through a heat exchanger along with the first resist line.

18. The method of claim 17, further including unscrewing the single tip nozzle from the nozzle holder.

19. The method of claim 13, wherein coupling the multiple tip nozzle to the nozzle holder includes rotating the dual tip nozzle relative to the nozzle holder block less than ninety degrees.

20. The method of claim 19, wherein coupling the multiple tip nozzle to the nozzle holder includes placing an end of the multiple tip nozzle within an opening in the nozzle holder.

* * * * *